US007117655B2

(12) United States Patent
Wells

(10) Patent No.: US 7,117,655 B2
(45) Date of Patent: Oct. 10, 2006

(54) METHOD OF APPLYING AT LEAST ONE WEB OF INSULATOR MATERIAL TO MULTIPLE SPRING ASSEMBLIES

(75) Inventor: Thomas J. Wells, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 830 days.

(21) Appl. No.: 10/354,756

(22) Filed: Jan. 30, 2003

(65) Prior Publication Data

US 2003/0110735 A1 Jun. 19, 2003

Related U.S. Application Data

(63) Continuation-in-part of application No. 10/143,377, filed on May 10, 2002, now abandoned, which is a continuation-in-part of application No. 10/034,823, filed on Dec. 27, 2001, now Pat. No. 6,467,239, which is a continuation-in-part of application No. 09/712,503, filed on Nov. 14, 2000, now abandoned, which is a continuation-in-part of application No. 09/397,337, filed on Sep. 15, 1999, now abandoned.

(51) Int. Cl.

| | |
|---|---|
| ***B65B 63/04*** | (2006.01) |
| ***A47C 23/04*** | (2006.01) |
| ***A47C 17/00*** | (2006.01) |
| ***A47C 16/00*** | (2006.01) |

(52) U.S. Cl. ..... 53/430; 53/118; 53/376.5; 5/654.1; 5/721; 5/739; 29/91.1

(58) Field of Classification Search ..... 53/430, 53/383.1, 376.5, 118, 14; 5/654.1, 739, 688.7, 5/721; 29/91.1, 91.5, 91.6

See application file for complete search history.

(56) References Cited

U.S. PATENT DOCUMENTS

| | | | |
|---|---|---|---|
| 1,643,091 | A | 9/1927 | Rosenthal et al. |
| 1,685,851 | A | 10/1928 | McInerney |
| 1,898,573 | A | 2/1933 | Schubert |
| 2,114,008 | A | 4/1938 | Wunderlich |
| 2,129,038 | A | 9/1938 | Schob |
| 2,193,410 | A | 3/1940 | Schubert |
| 2,247,543 | A | 7/1941 | Bernstein |
| 3,111,690 | A | 11/1963 | Tarlow |
| 3,200,418 | A | 8/1965 | Lebens |
| 3,325,833 | A | 6/1967 | Withoff |
| 3,576,040 | A | 4/1971 | Larsen |
| 3,579,774 | A | 5/1971 | Shreve |
| 3,813,843 | A | 6/1974 | Wooldridge et al. |
| 4,194,255 | A | 3/1980 | Poppe |
| 4,244,089 | A | 1/1981 | Cavaler |
| 4,602,471 | A | 7/1986 | Gray et al. |
| 4,669,247 | A | 6/1987 | Woffendin |
| 4,711,067 | A | 12/1987 | Magni |

(Continued)

*Primary Examiner*—Rinaldi I. Rada
*Assistant Examiner*—Christopher Harmon
(74) *Attorney, Agent, or Firm*—Wood, Herron & Evans, LLP

(57) ABSTRACT

A method of applying at least one web of insulator material to a plurality of spring assemblies is provided. Each web of insulator material is unwound from a roll, passed along a roller and applied to multiple spring assemblies which are passed between rollers. Each web of insulator material is folded around outermost coil springs along longitudinal edges of the spring assemblies. Side portions of each web of insulator material are glued, welded or otherwise permanently secured to a middle portion of the web of insulator material.

15 Claims, 3 Drawing Sheets

U.S. PATENT DOCUMENTS 4,995,162 A 2/1991 Beteré Cabeza
5,432,964 A 7/1995 Strell
5,438,718 A 8/1995 Kelly et al.
5,761,784 A 6/1998 Ogle et al.
6,175,997 B1 * 1/2001 Mossbeck ..... 29/91
6,357,209 B1 3/2002 Mossbeck et al.

* cited by examiner

METHOD OF APPLYING AT LEAST ONE WEB OF INSULATOR MATERIAL TO MULTIPLE SPRING ASSEMBLIES

CROSS-REFERENCE TO RELATED APPLICATIONS

This patent application is a continuation-in-part application of U.S. patent application Ser. No. 10/143,377 filed May 10, 2002 entitled METHOD OF PACKAGING SPRING UNITS ", now abandoned" U.S. patent application Ser. No. 10/143,377 is a continuation-in-part application of U.S. patent application Ser. No. 10/034,823 filed Dec. 27, 2001, now U.S. Pat. No. 6,467,239, entitled METHOD OF PACKAGING SPRING UNITS, which is a continuation-in-part application of U.S. patent application Ser. No. 09/712,503 filed Nov. 14, 2000, entitled METHOD OF PACKAGING SPRING UNITS, now abandoned. U.S. patent application Ser. No. 09/712,503 is a continuation-in-part application of U.S. patent application Ser. No. 09/397,337, filed Sep. 15, 1999, entitled "METHOD OF PACKAGING SPRINGS AND RESULTING PACKAGED PRODUCT", now abandoned. All of the above-identified applications are fully incorporated by reference herein.

FIELD OF THE INVENTION

This invention relates to the process of securing at least one web of insulator material to multiple spring assemblies.

BACKGROUND OF THE INVENTION

At the present time, most mattress spring core assemblies are manufactured by a spring manufacturer who assembles the springs into a spring assembly. To save space and therefore reduce shipping costs, the spring manufacturer compresses multiple spring assemblies and ties them in a crate. The crates are shipped to a mattress manufacturer, who then uncrates the compressed spring cores, applies a primary insulator to the top and bottom surfaces of the mattress, and then applies conventional padding and upholstery to complete the mattress. In order to keep the mattress spring assemblies straight and avoid the mattresses top and bottom surfaces being permanently canted and distorted as the spring assemblies are compressed for shipment in a crate, there are rods inserted through the spring assemblies during the compression process. These rods function to prevent misalignment of the top and bottom surfaces of the spring assemblies during compression, which rods are then removed after compression and during shipment within the crate.

As an alternative to compression of the spring assemblies for shipment in crates, some spring assemblies are compressed and roll-packed while sandwiched only between separator plies of paper or plastic, which paper or plastic may be either discarded or reused, depending on the nature of the separating materials.

For instance, it is known in the art to roll-pack multiple spring assemblies or units for use in making mattresses by winding disposable paper or re-usable hessian around a mandrel and feeding the spring units successively into the nip between the growing roll and the traveling web material. The spring units are compressed as they are drawn into the roll, and the result is that the roll-packed spring assemblies have a much reduced volume as compared to conventionally stacked spring units.

Prior art roll packing machines compress and wrap spring assemblies in a single web of disposable paper or reusable material which separates the multiple layers of spring assemblies in a roll and maintains the spring assemblies in a compressed state for shipment from a spring manufacturer to a mattress manufacturer. The mattress manufacturer then must unroll the spring units and manually attach an insulator pad to at least the top and usually the top and bottom surfaces of each spring unit before adding conventional padding and upholstery to the unit to complete the mattress. The insulator pads prevent the conventional filling materials such as padding from falling between the wire gaps in the spring assembly. The manual application of these insulator pads is time consuming and costly because it requires an operator manually securing the insulator pads to the spring assemblies with hog rings or other fasteners.

Applicant's U.S. Pat. No. 6,357,209, which is fully incorporated by reference herein, discloses a method of packaging spring units in which at least one layer of insulator material is permanently secured to multiple spring units before the spring units and insulator material are roll packed. The roll packed bedding products are then shipped in a roll to a mattress manufacturer who unrolls them and applies padding or other filling materials before encased each spring unit in a fabric covering.

However, in certain circumstances, a mattress manufacturer may receive a roll of roll packed spring assemblies which do not have any webs of insulator material attached thereto. In such a situation, the mattress manufacturer must unroll the roll packed spring assemblies and subsequently apply at least one web of insulator material to each spring assembly before padding and/or filling materials are added and the product encased in fabric. Heretofore, this process has been manual, an operator hog ringing or otherwise securing at least one web of insulator material individually to each spring assembly. This manual application of the insulator pads is time consuming and costly because among other things, this process requires a skilled, trained operator.

Therefore, it has been one objective of the present invention to provide an automated method of quickly and easily securing at least one web of insulator material to multiple spring assemblies.

It has been a further objective of the present invention to facilitate and ease the manufacture of spring mattresses by a mattress manufacturer.

SUMMARY OF THE INVENTION

The present invention accomplishes these objectives with a method of applying at least one web of insulator material to multiple spring assemblies. Each spring assembly preferably comprises a plurality of interconnected coil springs. Each of the coil springs has an upper end turn, a lower end turn and a plurality of central convolutions therebetween, as is conventional. However, other types of springs including continuous bands of coil springs may be incorporated into the spring assembly in accordance with the present invention.

The method of the invention allows at least one web of spring insulator material to be secured or attached to a plurality of spring units or spring assemblies in an automated manner so as eliminate the need for an operator. The process of the present invention enables a mattress manufacturer to unroll multiple spring assemblies from a roll of roll-packed spring assemblies and feed them one at a time into a space or nip between guide rollers. Any type of unroller may be used in accordance with the present invention. Alternatively, the mattress manufacture may uncrate a crate of compressed spring assemblies and feed the spring assemblies one at a time into the nip one at a time for application of the web or webs of insulator material thereto.

The nip or distance between the guide rollers is preferably slightly less than the height of the spring assemblies so that each spring assembly which passes therebetween is slightly compressed. The result of the slight compression is that when each web of insulator material is applied, it becomes taught on the top or bottom surface of the spring assembly.

Each spring assembly preferably has a uniform depth defined by a generally planar top first surface and a parallel generally planar bottom second surface. The spring assembly has a longitudinal dimension or length defined by a pair of opposed parallel end surfaces and a transverse dimension or width defined by a pair of opposed parallel side surfaces. The longitudinal dimension or length is generally greater than the transverse dimension or width of the spring assembly as in most bedding products. However, a square spring assembly in which the longitudinal and transverse dimensions are equal may also have one or more webs of insulator material applied thereto using this inventive method.

The method of the present invention comprises feeding or introducing spring assemblies into a space or nip between a pair of guide rollers spaced from one another. The spring assemblies are preferably oriented with the longitudinal dimension of the spring assembly parallel the direction of travel so that a leading end surface of the spring assembly is first introduced between the guide rollers. However, the spring assemblies may be oriented in any manner without departing from the spirit of the present invention.

First and second web rolls of insulator material are preferably provided generally above and below the spring assemblies, respectively. The first web roll comprises a first web of spring insulator material, e.g., bonded fiber or non-woven fiber or other web material, wound about a core. Similarly, the second web roll comprises a second web of similar spring insulator material wound about a core. However, the webs of insulator material may be stored in other ways and at other locations. Each of the first and second webs of insulator material have a pair of opposed side edges defining a width of the web which is wider than the spring assemblies' transverse dimension. Each web across its width has a pair of opposed side portions and a central portion between the side portions.

The first and second webs of insulator material are each passed over a guide roller and located against the first and second surfaces of the spring assembly, respectively. The longitudinal dimension of the spring assembly is preferably parallel to the opposed side edges of the first and second webs of insulator material. However, the spring assemblies may be oriented such that the transverse dimension of the spring assembly is generally parallel to the opposed side edges of the first and second webs of insulator material.

Either before, during or after the process of being wound around a respective guide roller, a bonding material is applied to the inner surface of each of the side portions of each web of insulator material. The bonding material is preferably adhesive but may be other material such as, for example, a molten plastic material. The bonding material may be extruded or otherwise applied to the inner surfaces of the webs of insulator material.

The next step in the method of the present invention is to fold each of the webs of insulator material back upon itself around the top and bottom turns of the edgemost coil springs of the spring unit, respectively, so that the inner surfaces of the opposed side portions of each web of insulator material are located against the inner surface of the central portion of the web of insulator material. This central portion of each web of insulator material is located against either the top or bottom surface of the spring assembly. The bonding material is then allowed to dry, thereby securing the side portions of each web of insulator material to the central portion of the web of insulator material with the end turns of the coil springs trapped therebetween. In this manner, each web of insulator material is secured to the spring assembly.

In an alternative embodiment of the method of the present invention, the web or webs of insulator material may be secured to the spring assemblies after being folded. In this embodiment of the present invention, the side portions of each web of insulator material are welded, sewn or otherwise secured to the central portion of the web of insulator material at a securement station which is "downstream" of the location where the web or webs of insulator material are folded around the outermost end turns of the spring assemblies. Thus, in this embodiment the side portions of each web of insulator material are secured to the central portion of the web of insulator material after the web of insulator material is folded.

The final step in the method of the present invention is to cut the web or webs of insulator material between adjacent spring assemblies.

The spring assembly with the first and second webs of insulator material secured thereagainst constitutes a bedding or seating product to which padding may be subsequently applied before the product is encased in a covering. The web or webs of insulator material prevent the padding from falling between the wire gaps of the spring assembly.

These and other objectives and advantages of this invention will be readily apparent from the following description of the drawings.

DETAILED DESCRIPTION OF THE PREFERRED EMBODIMENT

Figure 1:
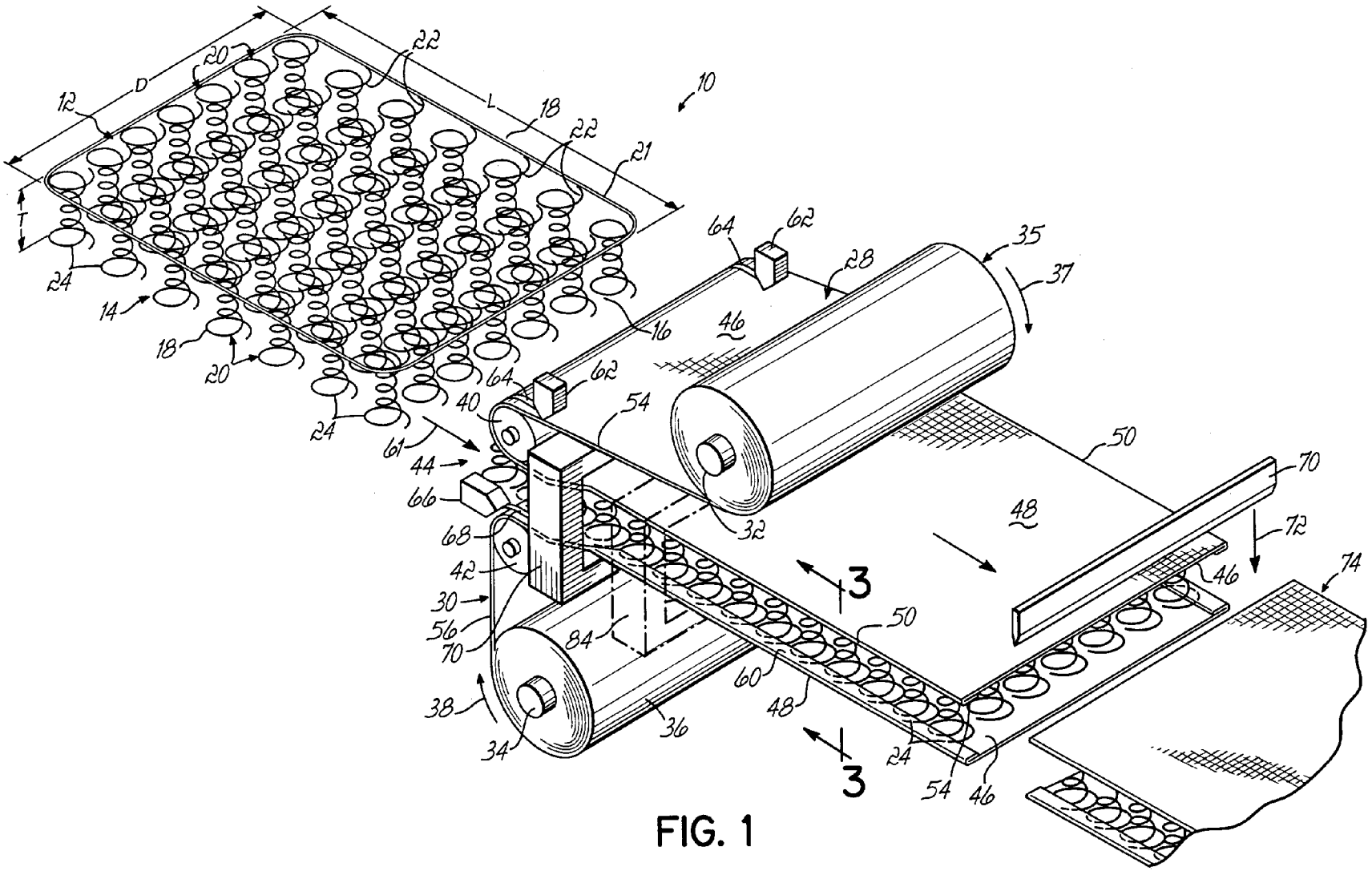
FIG. 1 is a perspective view of the present inventive method of applying webs of insulator material to a resilient spring assembly.

Referring to the drawings and particularly FIG. 1, a spring assembly 10 having a top or first surface 12 and a bottom or second surface 14 is illustrated. The spring assembly 10 has a length or a longitudinal dimension L defined as the distance between opposing end surfaces 16 and a width or a transverse dimension D defined as the distance between opposing side surfaces 18. Typically, the longitudinal dimension L is larger than the transverse dimension D; however, it will be appreciated by those in the art that the length and width may be substantially similar. The spring assembly 10 has a thickness T between the first surface 12 and the second surface 14.

Figure 3:
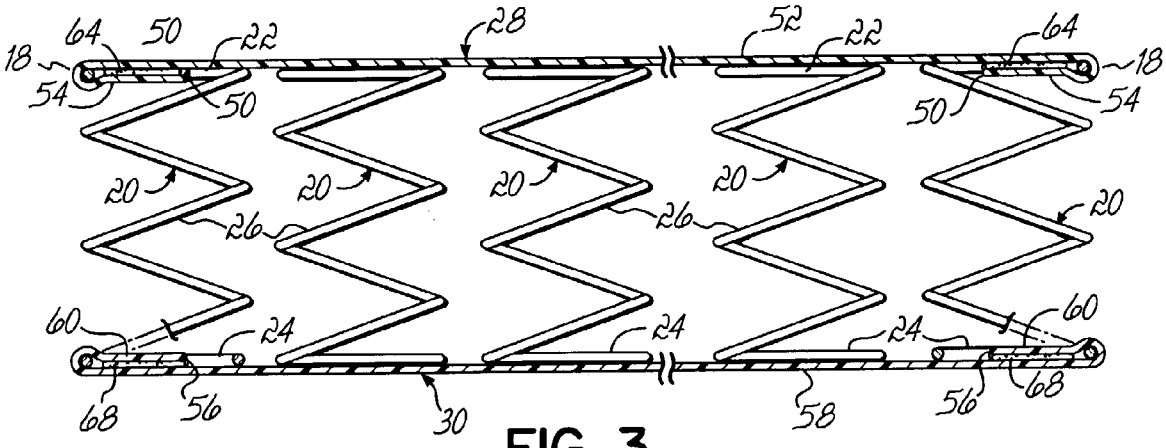
FIG. 3 is a cross-sectional view taken along line 3—3 of FIG. 1.

The spring assembly 10 is generally comprised of a plurality of coil springs 20, the coil springs 20 being secured one to another by means generally known in the art, such as helical lacing wires (not shown), for example. At least one border wire 21 may surround the assembled springs 20. As best illustrated in FIG. 3, each coil spring 20 has a top turn 22 comprising a portion of the first surface 12, a bottom turn 24 comprising a portion of the second surface 14 and a plurality of central convolutions 26 therebetween. Springs other than coil springs may be used in accordance with the present invention. In addition, springs of differing heights may be used in accordance with the present invention.

Figure 2:
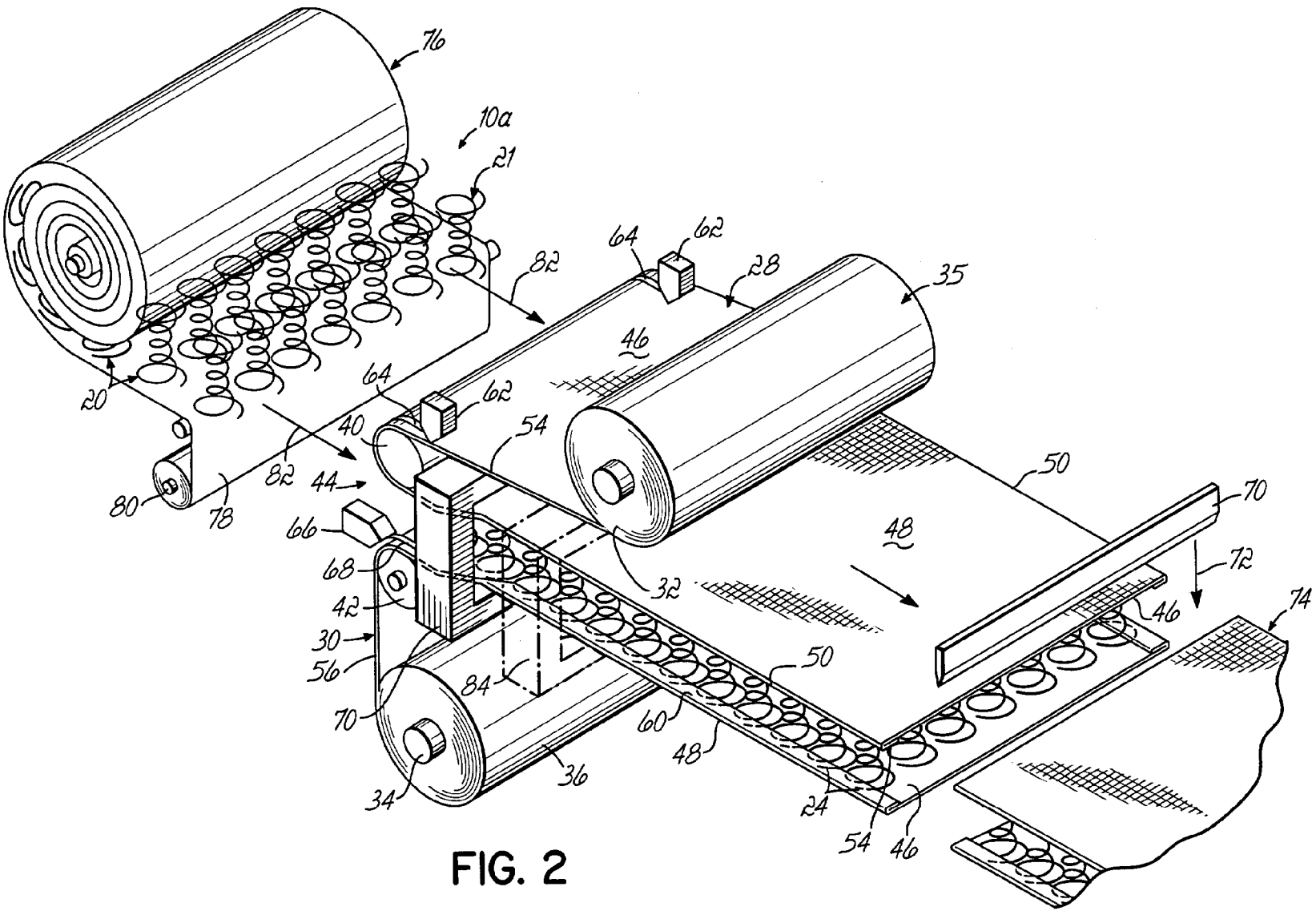
FIG. 2 is a perspective view of a method of applying webs of insulator material to a spring assembly after the spring assembly has been unrolled from a roll pack.

As illustrated in FIGS. 1 and 2, first and second webs of insulator material 28, 30 are wound about first and second cores 32, 34 into web rolls 35, 36, respectively. The first and second webs of insulator material 28, 30 may be unrolled therefrom in directions as indicated by directional arrows 37, 38, respectively. The first and second webs of insulator material 28, 30 are drawn between respective first and second guide rollers 40, 42. Preferably, guide rollers 40, 42 are spaced apart from each other so that spring assembly 10 may be slightly compressed when passed therebetween. A space or nip 44 is defined between the first and second guide rollers 40, 42. The guide rollers 40, 42 may be spaced such that the spring assemblies 10 passed therebetween are slightly compressed or not compressed at all.

Each of the first and second webs of insulator material 28, 30 has an inner surface 46 and an outer surface 48. As the first and second webs of insulator material 28, 30 are passed around the guide rollers 40, 42, the outer surfaces 48 of the first and second webs of insulator material 28, 30 contact the guide rollers 40, 42. After the first and second webs of insulator material 28, 30 are secured to the spring assembly 10, the inner surfaces 46 of the first and second webs of insulator material 28, 30 are located against the first and second surfaces 12, 14 of the spring assembly 10.

As best illustrated in FIG. 3, the first web of insulator material 28 has a pair of side edges 50 between which is a center portion 52 and opposed side portions 54. Similarly, the second web of insulator material 30 has a pair of side edges 56 between which is center portion 58 and opposed side portions 60. Each of the first and second webs of insulator material 28, 30 has a substantially similar width W defined as the distance between the side edges 50, 56, respectively. See FIG. 1. The width W of each web of insulator material is larger than the transverse dimension D of the spring assembly 10 so that the opposed side portions 54, 60 of the first and second webs of insulator material 28, 30, respectively generally extend beyond the transverse dimension D of the spring assembly 10 in substantially equal amounts. The lengths (not indicated) of the first and second webs of insulator material 28, 30 are considerably longer than the longitudinal dimension L of a single spring assembly 10 so that the webs of insulator material 28, 30 may be applied to plural spring assemblies 10 by the inventive method described in further detail below.

Referring to FIG. 1, the method of the present invention comprises first introducing or feeding the spring assembly 10 into the nip 44 between guide rollers 40, 42 in the direction of arrow 61. The spring assembly 10 is oriented such that the side surfaces 18 of the spring assembly 10 are generally parallel the side edges 50, 56 of the first and second webs of insulator material 28, 30. However, the spring assembly 10 may be oriented in other directions, such as for example with the end surfaces 16 of the spring assembly 10 generally parallel the side edges 50, 56 of the first and second webs of insulator material 28, 30, respectively.

As illustrated in FIG. 1, each spring assembly 10 is introduced or fed into the nip 44 between guide rollers 40, 42 in the direction of arrow 61 one at a time. The spring assemblies may be unrolled from a roll of roll-packed spring assemblies as illustrated in FIG. 1A and described below, removed from a crate of compressed spring assemblies or unpacked any other way before being introduced one spring assembly 10 at a time into the nip 44 between guide rollers 40, 42.

The webs of insulator material 28, 30 are unwound or unrolled from web rolls of insulator material 35, 36. Alternatively, the webs of insulator material may be unpackaged from a stack or pile or any other storage device or configuration. The webs of insulator material 28, 30 are passed around guide rollers 40, 42 before being located against the first and second surfaces 12, 14, respectively, of the spring assembly 10.

As illustrated in FIG. 1, either before, after or while the first and second webs of insulator material 26, 28 are passed around guide rollers 40, 42, applicators 62 deposit a bonding material 64 such as adhesive against the inner surface 46 of the side portions 54 of the first web of insulator material 26. Although FIG. 1 illustrates the applicators 62 being located above the first web of insulator material 28, they may be located elsewhere without departing from the spirit of this invention. Similarly, either before, after or while the second web 30 of insulator material is passed around guide roller 42 applicators 66 deposit a bonding material 68 such as adhesive against the inner surface 46 of the side portions 60 of the second web of insulator material 30. Although FIG. 1 illustrates the applicators 66 being located generally in front of the guide roller 42, they may be located elsewhere without departing from the spirit of this invention.

The spring assembly 10 having the first and second webs of insulator material 28, 30 located thereagainst is then passed to a folding unit 70 which folds the side portions 54, 60 of each of the first and second webs of insulator material 28, 30 around the end turns of the outer coil springs 20. More particularly, the inner surface 46 of the side portions 541 60 of each of the first and second webs 28, 30 with the bonding agent 64, 68 deposited thereon are folded around the upper and lower end turns 22, 24 of the outermost coil springs 20 before being pressed against the inner surfaces 46 of the respective center portions 52, 58. The top and bottom end turns 22, 24 of the coil springs 20 comprising the longitudinal margins of the spring assembly 10 are trapped between the side portions and center portions of the first and second webs of insulator material 28, 30. In this manner the first and second webs of insulator material 28, 30 are secured to the coil springs 20 of the spring assembly 10.

The bonding agent is then allowed to dry such that the bonding agent secures the side portions 54, 60 of the first and second webs of insulator material 28, 30 to the center portions 52, 58 of the first and second webs of insulator material 28, 30.

As illustrated in FIGS. 1 and 2, an alternative embodiment of the present invention is illustrated. In this embodiment, the first and second webs of insulator material 28, 30 are secured to the spring assemblies 10 at a securement station 84 (shown in dashed lines). In this embodiment, the side portions 54, 60 of the first and second webs of insulator material 28, 30 are secured to the center portions 52, 58, respectively at the securement station 84 using any of numerous method including but not limited to sewing or ultasonic welding. The welding together of the side and center portions of each of the first and second webs of insulator material 28, 30 may be accomplished by any suitable welding process for woven or non-woven materials known in the art, e.g., ultrasonic or radio frequency welding, to create a weld or bond. In this embodiment, the applicators 62, 66 may not be activated or may be omitted entirely.

The insulator material used to cover the first and second surfaces 12, 14 of the spring unit 10 is generally a woven or non-woven material but may be any other flexible sheet of web material.

In one preferred embodiment, after the bonding agent drys, the first and second surfaces 12 of the spring assemblies 10 are covered with the webs 28, 30 of insulator material. After the webs of insulator material 28, 30 have been fixedly located against the first and second surfaces 12, 14 of the spring unit 10 by either the gluing or the welding methods as described above or any other conventional securement method, the spring assemblies 10 with the first and second webs of insulator material 26, 28 located there against are then passed to a cutter 70 which transversely cuts in a direction 72 the webs of insulator material 28, 30 at locations between adjacent, spaced spring assemblies 10.

The spring assembly 10 with the first and second webs of insulator material 28, 30 attached permanently thereto comprises a bedding or seating product 74 ready for shipment, for example, from a spring manufacturer to a mattress or seat manufacturer.

When the bedding or seating products 72 arrive at the mattress or seat manufacturer's facility, all that the manufacturer need do is unpack the products 72 and apply the necessary padding and upholstery material. The resulting bedding or seating product 72 having the insulator material permanently secured to its top and bottom sides is than ready for application of the appropriate padding and upholstery materials to complete the mattress or seat.

FIG. 2 illustrates an alternative embodiment of the present invention. In this embodiment, the method includes a step of unrolling a plurality of spring assemblies 10*a* from a roll 76 of compressed spring assemblies 10*a*. Within the roll 76 of compressed spring assemblies 10*a*, separator material 78 is wound about a core 80 as the roll 76 of compressed spring assemblies 10*a* is being unrolled. Either after the spring assemblies 10*a* are unrolled or while the spring assemblies 10*a* are being unrolled, the spring assemblies 10*a* are moved, one at a time, in the direction of arrows 82 into the nip 44 between the guide rollers 40, 42.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A method of applying a web of insulator material to a spring assembly, said web of insulator material being adapted to separate said spring assembly from padding to be applied to said spring assembly, said method comprising:

feeding a spring assembly between a pair of guide rollers;

unrolling a web of insulator material from a roll of said insulator material;

passing said web of insulator material around one of said guide rollers;

folding said outer edges of said web of insulator material around end turns of springs of said spring assembly; and securing said web of insulator material to itself to secure said web of insulator material to said spring assembly.

2. The method of claim 1 wherein said spring assembly is unrolled from a roll of compressed spring assemblies prior to being fed between said pair of guide rollers.

3. The method of claim 1 further comprising cutting said web of insulator material between adjacent spring assemblies.

4. A method of applying a web of insulator material to a spring assembly, said web of insulator material being adapted to separate said spring assembly from padding to be applied to said spring assembly, said method comprising:

feeding a spring assembly between a pair of guide rollers;

unrolling a web of insulator material from a roll of said insulator material;

applying a bonding agent along outer edges of said web of insulator material;

passing said web of insulator material around one of said guide rollers;

folding said outer edges of said web of insulator material around end turns of springs of said spring assembly; and allowing said bonding agent to dry to bond said web of insulator material to itself and secure said web of insulator material to said spring assembly.

5. The method of claim 4 wherein said spring assembly is unrolled from a roll of compressed spring assemblies prior to being fed between said pair of guide rollers.

6. The method of claim 4 further comprising cutting said web of insulator material between adjacent spring assemblies.

7. A method of securing a web of insulator material to a plurality of spring assemblies, each of said spring assemblies comprising a plurality of springs having end turns, said method comprising:

feeding a plurality of spring assemblies between a pair of guide rollers;

unrolling a web of insulator material from a roll of said insulator material, said web of insulator material having a pair of side portions and a central portion therebetween;

applying adhesive to said side portions of said web of insulator material;

passing said web of insulator material around one of said guide rollers;

folding said side portions of said web of insulator material around select end turns of springs of each of said spring assemblies;

allowing said adhesive to dry such that said adhesive bonds said side portions of said web of insulator material to said central portion of said web of insulator material and secures said web of insulator material to said each of said spring assemblies; and cutting said web of insulator material between adjacent spring assemblies.

8. The method of claim 7 wherein said spring assemblies are unrolled from a roll of compressed spring assemblies prior to being fed between said pair of guide rollers.

9. A method of applying first and second webs of insulator material to a spring assembly, said webs of insulator material being adapted to separate said spring assembly from padding to be applied to said spring assembly, said method comprising:

unrolling a spring assembly from a roll of compressed spring assemblies;

feeding the spring assembly between a pair of rollers to compress said spring assembly;

unrolling first and second webs of insulator material from rolls of said insulator material;

applying a bonding material along outer edges of each web of insulator material on an inside surface thereof; and passing said webs of insulator material around said rollers, and folding said outer edges of said web of insulator material around end turns of springs of said spring assembly such that said bonding material secures each of said webs of insulator material to itself and secures said webs of insulator material to said spring assembly.

10. A method of securing webs of insulator material to a plurality of spring assemblies, each of said spring assemblies comprising a plurality of coil springs, each of said coil springs having a top turn and a bottom turn, each of said spring assemblies having a generally planar first surface defined by said top turns and a generally planar second surface defined by said bottom turns, a longitudinal dimension and a transverse dimension, said method comprising the steps of:

providing first and second web rolls of insulator material, each of said web rolls comprising a web of insulator material carried upon a core and each of said webs of insulator material having opposed side edges defining a width of said web, said web being wider than said transverse dimensions of said spring assemblies, each of said webs of insulator material having opposed side portions and a central portion between said side portions;

passing said first and second webs of insulator material over spaced rollers;

moving said spring assemblies between said spaced rollers, said spring assemblies being oriented such that said transverse dimensions of said spring assemblies are generally perpendicular to said opposed side edges of said webs of insulator material;

applying a bonding material to said side portions of said webs of insulator material;

locating said first and second webs against said first and second surfaces, respectively, of said spring assemblies so that each of said opposed side edges of each of said first and second webs extends beyond said transverse dimensions of said spring assemblies;

folding said side portions of said first and second webs of insulator material around said top and bottom turns, respectively, of said coil springs along said longitudinal dimensions of said spring assemblies so that each of said side portions of said first and second webs is folded back upon said respective center portion of each of said first and second webs of insulator material; and allowing said bonding material to dry to secure said side portions of said first and second webs of insulator material to said central portions of said first and second webs of insulator material.

11. The method of claim 10 further comprising the step of cutting said webs of insulator material between adjacent spring assemblies.

12. A method of securing webs of insulator material to a plurality of spring assemblies, each of said spring assemblies comprising a plurality of coil springs, each of said coil springs having a top turn and a bottom turn, each of said spring assemblies having a generally planar first surface defined by said top turns and a generally planar second surface defined by said bottom turns, a longitudinal dimension and a transverse dimension, said method comprising the steps of:

providing first and second webs of insulator material, each of said webs of insulator material having an inner surface, an outer surface and a generally uniform width including a pair of opposed side portions and a central portion between said side portions;

applying a bonding material to said inner surfaces of said side portions of said webs of insulator material;

passing said first and second webs of insulator material over spaced rollers;

moving said spring assemblies between said spaced rollers;

locating said first and second webs of insulator material against said top and bottom surfaces of said spring assemblies so that said inner surfaces of said webs of insulator material abut said top and bottom surfaces of said spring assemblies;

folding said side portions of said first and second webs of insulator material around said top and bottom turns of select coil springs of said spring assemblies; and drying said bonding material such that said side portions of each of said webs of insulator material are secured said central portion of said web of insulator material.

13. The method of claim 12 further comprising the step of cutting said webs of insulator material between adjacent spring assemblies.

14. A method of securing webs of insulator material to a plurality of spring assemblies, each of said spring assemblies comprising a plurality of coil springs, each of said coil springs having a top turn and a bottom turn, each of said spring assemblies having a generally planar top surface defined by said top turns and a generally planar bottom surface defined by said bottom turns, a longitudinal dimension and a transverse dimension, said method comprising the steps of:

moving said spring assemblies into a space between a pair of guide rollers;

providing first and second webs of insulator material, each of said webs of insulator material having an inner surface, an outer surface and a generally uniform width including a pair of opposed side portions and a central portion between said side portions;

passing said webs of insulator material between said guide rollers;

covering said top and bottom surfaces of said spring assemblies with said webs of insulator material folding said side portions of said webs of insulator material around said top and bottom turns of select coil springs of said spring assemblies; and securing said side portions of each of said webs of insulator material to said central portion of said web of insulator material.

15. The method of claim 14 further comprising the step of cutting said webs of insulator material between adjacent spring assemblies.

* * * * *

UNITED STATES PATENT AND TRADEMARK OFFICE

CERTIFICATE OF CORRECTION

PATENT NO. : 7,117,655 B2
APPLICATION NO. : 10/354756
DATED : October 10, 2006
INVENTOR(S) : Thomas J. Wells It is certified that error appears in the above-identified patent and that said Letters Patent is hereby corrected as shown below:

Column 1

Line 11, remove both occurrences of "(quotation marks)".

Line 44, change "mattresses" to --mattresses'--.

Column 2

Line 24, change "encased" to --encasing--.

Line 62, change "as eliminate" to --as to eliminate--.

Column 3

Line 1, change "manufacture" to --manufacturer--.

Line 3, delete the second occurrence of "one at a time".

Line 10, change "taught" to --taut--.

Column 6

Line 35, change "541" to --54,--.

Line 59, after "respectively", insert a --,--.

Line 60, change "method" to --methods--.

Column 7

Line 6, change "drys" to --dries--.

Line 13, change "26, 28" should be --28, 30--.

Column 8

Line 45, before the first occurrence of "said", insert --to--.

UNITED STATES PATENT AND TRADEMARK OFFICE

CERTIFICATE OF CORRECTION

PATENT NO. : 7,117,655 B2
APPLICATION NO. : 10/354756
DATED : October 10, 2006
INVENTOR(S) : Thomas J. Wells It is certified that error appears in the above-identified patent and that said Letters Patent is hereby corrected as shown below:

Column 10

Line 22, before the first occurrence of "said", insert --to--.

Line 45, after "material", insert a --;--.

Signed and Sealed this

Thirteenth Day of March, 2007

JON W. DUDAS
*Director of the United States Patent and Trademark Office*